US009169685B2

(12) United States Patent
Larson

(10) Patent No.: US 9,169,685 B2
(45) Date of Patent: Oct. 27, 2015

(54) LOCKABLE CONTAINER WITH SACRIFICIAL HOUSING AND METHODS FOR MAKING

(75) Inventor: Wayne F. Larson, Salem, OR (US)

(73) Assignee: UTC FIRE & SECURITY AMERICAS CORPORATION, INC., Bradenton, FL (US)

( * ) Notice: Subject to any disclaimer, the term of this patent is extended or adjusted under 35 U.S.C. 154(b) by 333 days.

(21) Appl. No.: 12/604,288

(22) Filed: Oct. 22, 2009

(65) Prior Publication Data

US 2011/0095028 A1 Apr. 28, 2011

(51) Int. Cl.

| | |
|---|---|
| ***E05B 19/00*** | (2006.01) |
| ***E05G 1/00*** | (2006.01) |
| ***E05B 17/00*** | (2006.01) |
| ***E05B 37/16*** | (2006.01) |
| ***E05B 65/00*** | (2006.01) |

(52) U.S. Cl.

CPC ..... *E05G 1/005* (2013.01); *E05B 17/0062* (2013.01); *E05B 37/16* (2013.01); *E05B 65/0075* (2013.01); *Y10T 292/68* (2015.04)

(58) Field of Classification Search

CPC . E05B 19/00; E05B 19/0005; Y10T 70/5031; Y10T 70/40; Y10T 70/489

USPC ..... 70/14, 57, 58, 63, 416, 417; 109/45, 109/49.5

See application file for complete search history.

(56) References Cited

U.S. PATENT DOCUMENTS

| | | | | |
|---|---|---|---|---|
| 4,325,239 | A | 4/1982 | Larson | |
| 4,325,240 | A * | 4/1982 | Gable | 70/284 |
| 4,577,477 | A * | 3/1986 | Olshausen | 70/58 |
| 4,626,007 | A | 12/1986 | Larson | |
| 4,632,439 | A * | 12/1986 | Miller | 292/166 |
| 4,852,503 | A | 8/1989 | Lichter | |
| 4,936,894 | A * | 6/1990 | Larson et al. | 70/298 |
| 4,988,987 | A * | 1/1991 | Barrett et al. | 340/5.28 |
| 5,280,518 | A * | 1/1994 | Danler et al. | 379/102.06 |
| 5,410,896 | A * | 5/1995 | Gleason | 70/202 |
| 5,758,522 | A * | 6/1998 | York | 70/63 |
| 5,768,921 | A | 6/1998 | Hill | |
| 5,791,172 | A * | 8/1998 | Deighton et al. | 70/63 |
| 5,927,111 | A * | 7/1999 | Nachbauer | 70/161 |
| 6,079,241 | A | 6/2000 | Burleigh et al. | |
| 6,418,766 | B1 * | 7/2002 | Luebeck | 70/371 |
| D467,789 | S * | 12/2002 | Laabs et al. | D8/343 |
| 6,813,912 | B1 * | 11/2004 | Ng et al. | 70/21 |

(Continued)

FOREIGN PATENT DOCUMENTS

| | | |
|---|---|---|
| DE | 358481 C | 9/1922 |
| WO | 2008094137 A2 | 8/2008 |

OTHER PUBLICATIONS

International Preliminary Examination Report and Written Opinion of International Searching Authority dated Apr. 24, 2012, PCT Application No. PCT/US2010/053811, (6 pages).

(Continued)

*Primary Examiner* — David E Sosnowski

*Assistant Examiner* — Ifeolu Adeboyejo

(74) *Attorney, Agent, or Firm* — Cantor Colburn LLP

(57) ABSTRACT

An improved lockable container, which is configured to resist being pried open or being otherwise successfully attacked within predetermined time and tool set limits. Also, methods for manufacturing and/or assembling embodiments of the lockable container.

17 Claims, 12 Drawing Sheets

(56) References Cited

U.S. PATENT DOCUMENTS

| | | | | |
|---|---|---|---|---|
| 6,945,405 | B1 * | 9/2005 | Bores et al. | 206/711 |
| 7,131,300 | B1 * | 11/2006 | Monasco | 70/55 |
| 7,318,331 | B2 * | 1/2008 | Miao | 70/214 |
| 7,484,389 | B2 * | 2/2009 | Sedon et al. | 70/57 |
| 2001/0023601 | A1 * | 9/2001 | Gilbertson et al. | 70/258 |
| 2003/0179075 | A1 * | 9/2003 | Greenman | 340/5.54 |
| 2008/0098939 | A1 * | 5/2008 | Kalous et al. | 109/52 |
| 2008/0257233 | A1 * | 10/2008 | Pallo et al. | 109/45 |

OTHER PUBLICATIONS

European Office Action for application EP 10774369.2, dated Feb. 19, 2015, 4 pages.

* cited by examiner

LOCKABLE CONTAINER WITH SACRIFICIAL HOUSING AND METHODS FOR MAKING

CROSS-REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO A JOINT RESEARCH AGREEMENT

Not Applicable

REFERENCE TO A SEQUENCE LISTING, A TABLE, OR COMPUTER PROGRAM LISTING APPENDIX SUBMITTED ON COMPACT DISC

Not Applicable

BACKGROUND OF THE INVENTION

1. Field of the Invention

The field of the invention relates to key control generally, and more particularly to certain new and useful advances in lockable containers and the manufacture thereof, of which the following is a specification, reference being had to the drawings accompanying and forming a part of the same.

2. Description of Related Art

Sundry types of lockable containers, such as lockboxes of the pushbutton and electronic type are known, but many lockboxes, particularly those configured for use in the private residential and assisted living markets, cannot successfully resist or thwart physical assaults, with one or more kinds of tools, such as hammers, screwdrivers, pliers and the like, for durations of a minute or longer.

BRIEF SUMMARY OF THE INVENTION

Disclosed and/or claimed herein is an improved lockable container, which is configured to resist being pried open or otherwise being successfully attacked within predetermined time and tool set limits, such as those defined by the Loss Prevention Certification Board's (LPCB's) Loss Prevention Standard (LPS) 1175 Level 1, which is promulgated and maintained by BRE Global Limited of Watford, United Kingdom, or other attack-resistance standards. Methods for manufacturing and/or assembling embodiments of the improved lockable container are also disclosed. Other features and advantages of the improved lockable container will become apparent by reference to the following description taken in connection with the accompanying drawings.

BRIEF DESCRIPTION OF THE SEVERAL VIEWS OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION OF THE INVENTION

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Improved Lockable Container

Figure 1:
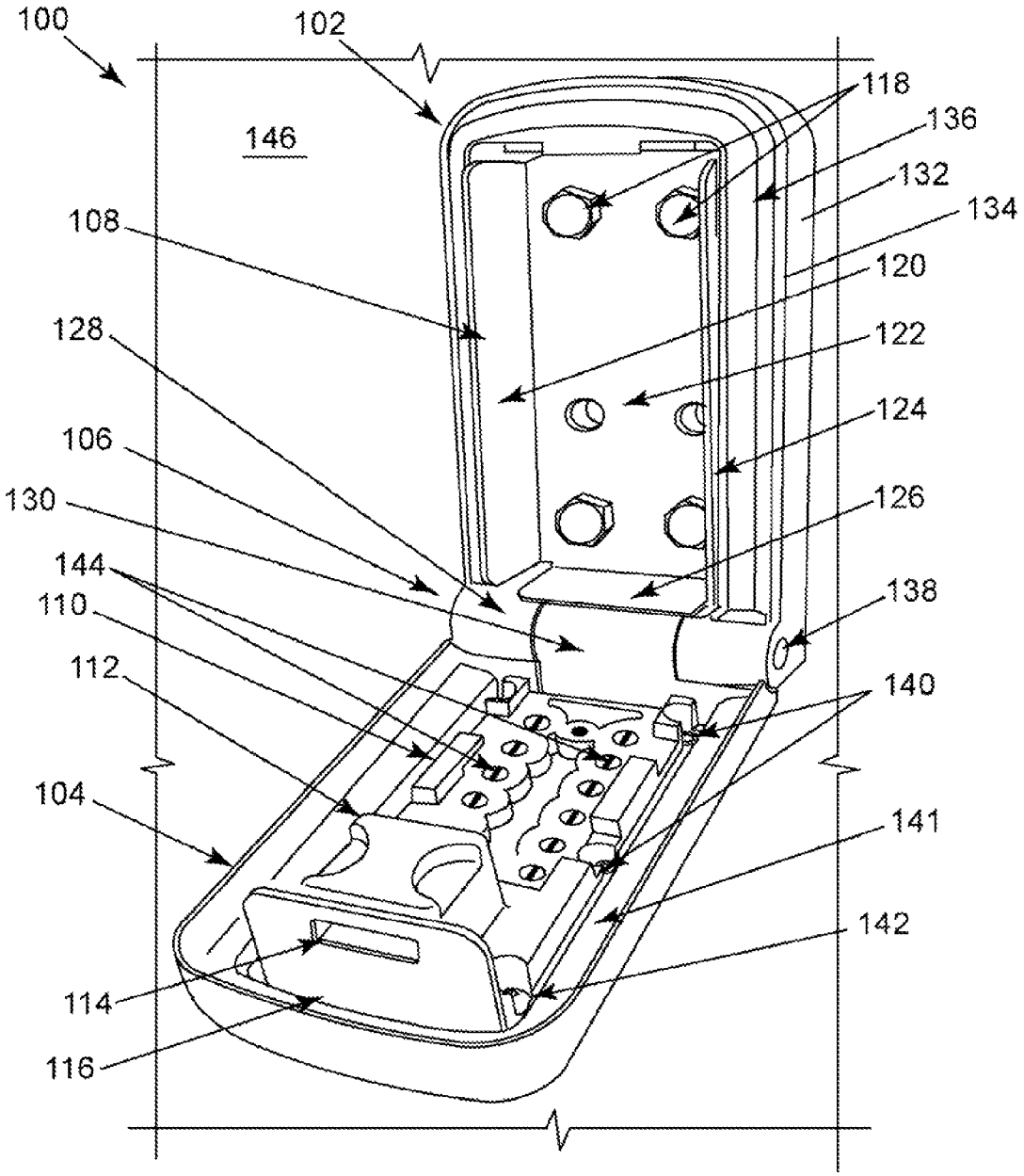
FIG. 1 is a right-side perspective view an embodiment of a lockable container in an open position.
Figure 2:
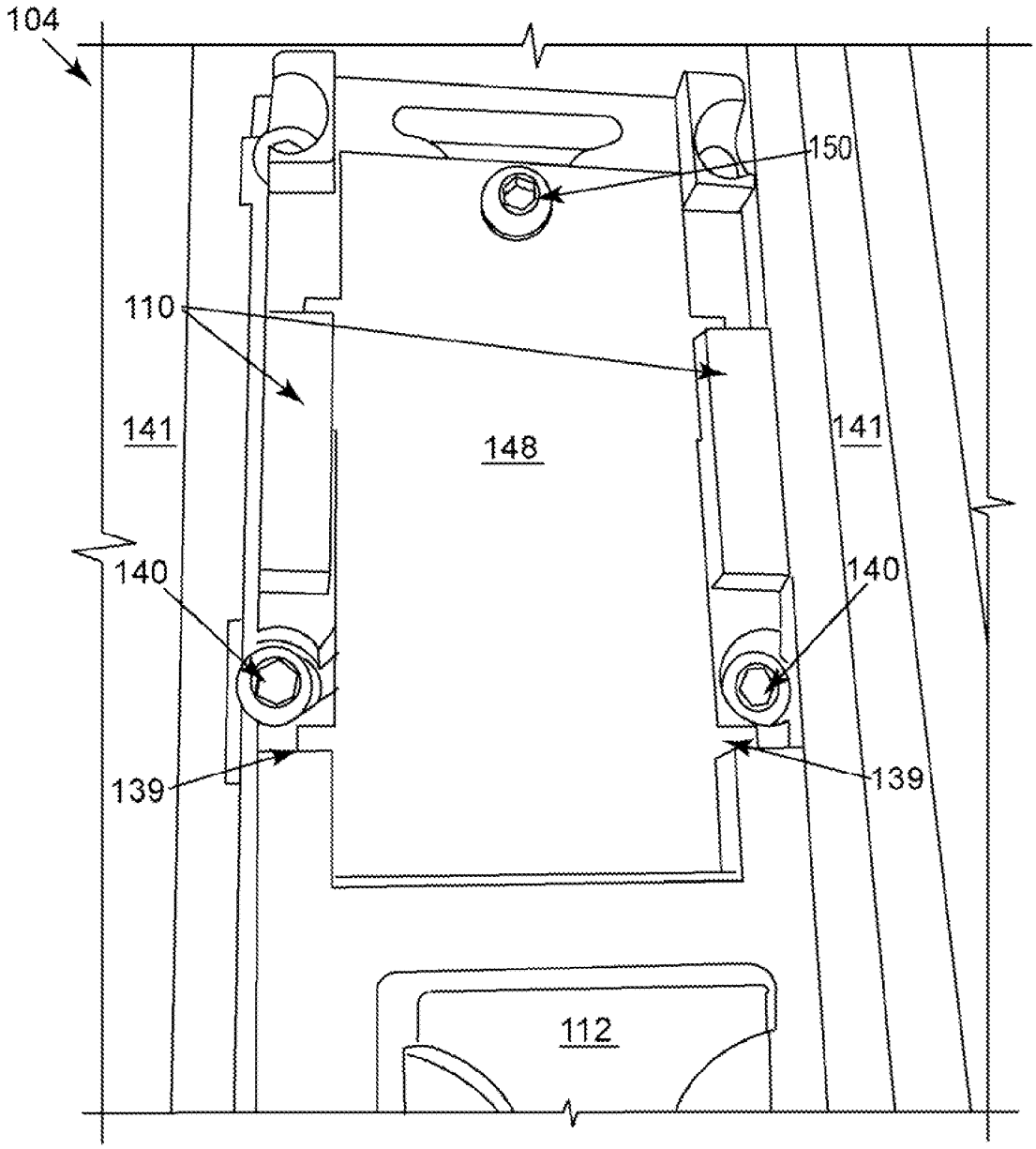
FIGS. 2, 3 and 5 are each a top perspective view of an interior of a second housing of the lockable container of FIG. 1.
Figure 3:
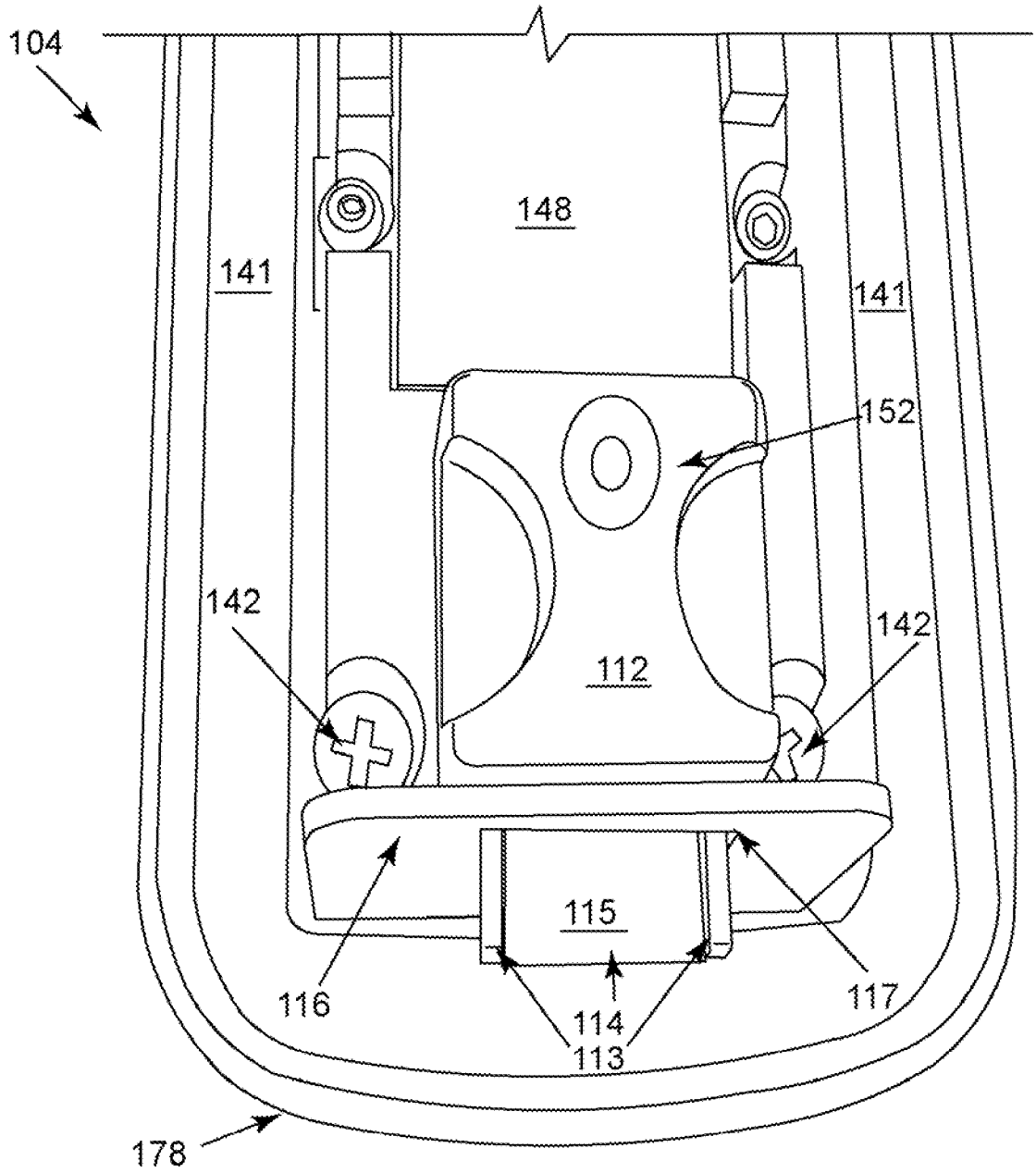
Figure 4:
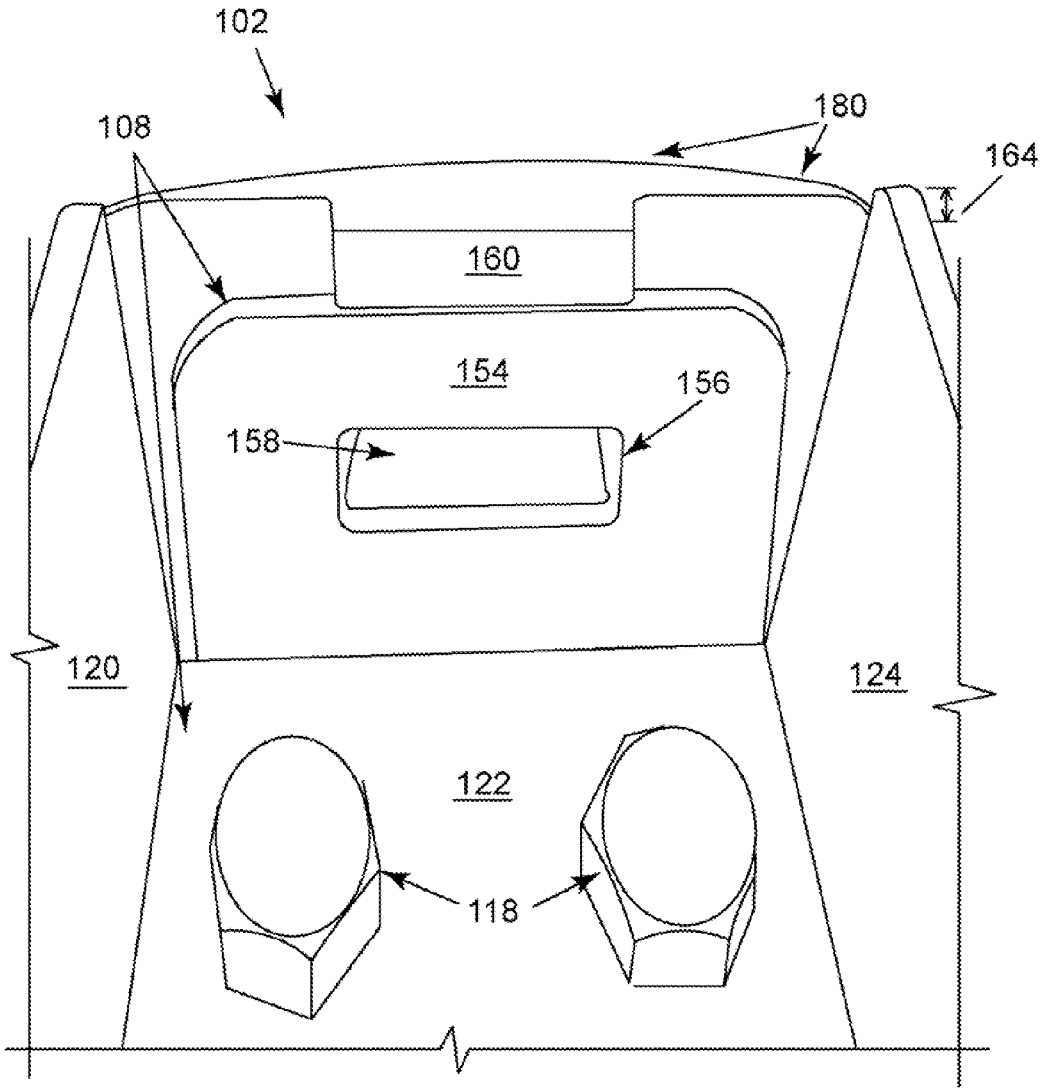
FIG. 4 is a top perspective view of an interior of a first housing of the lockable container of FIG. 1.
Figure 5:
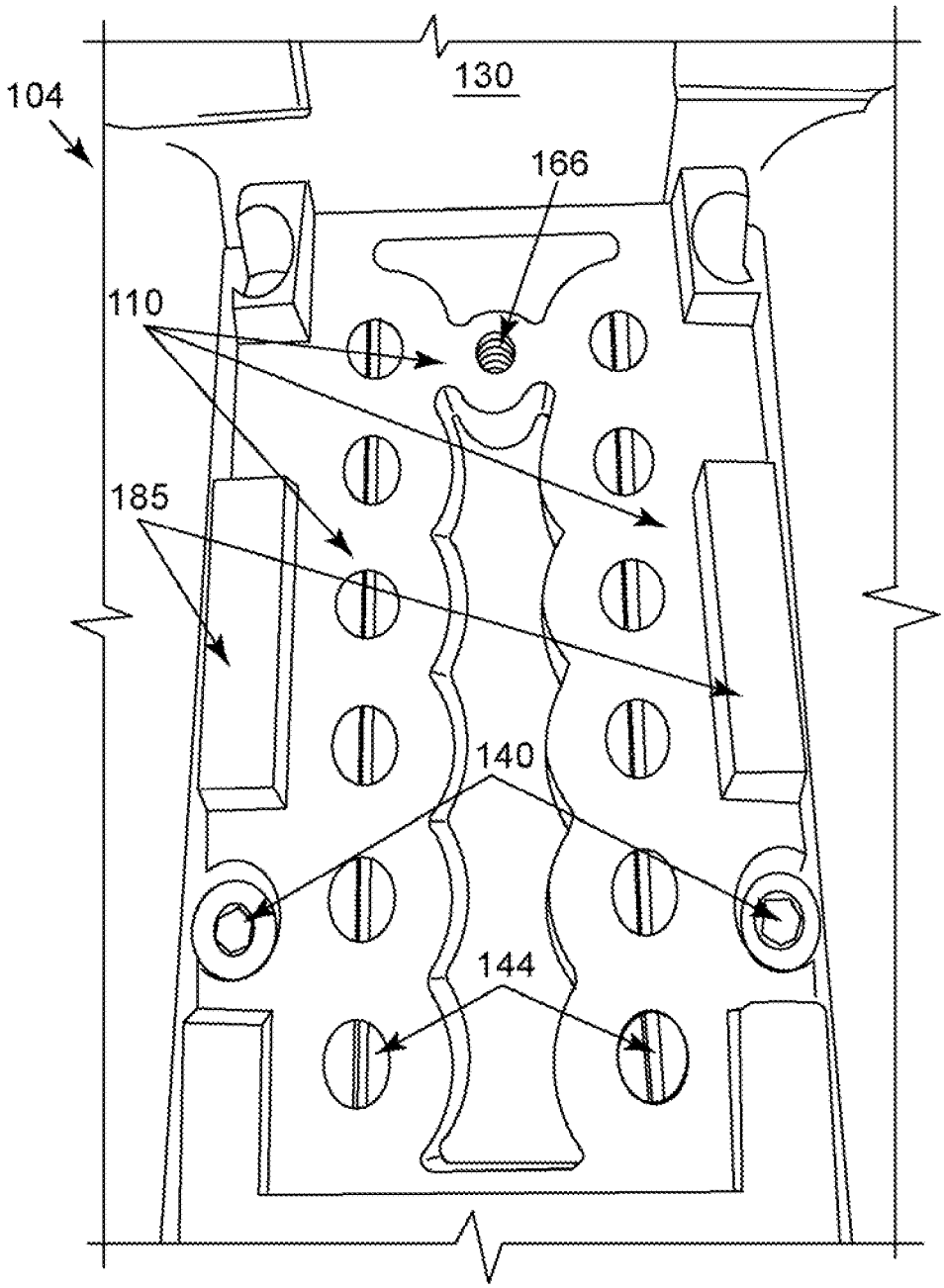
Figure 6:
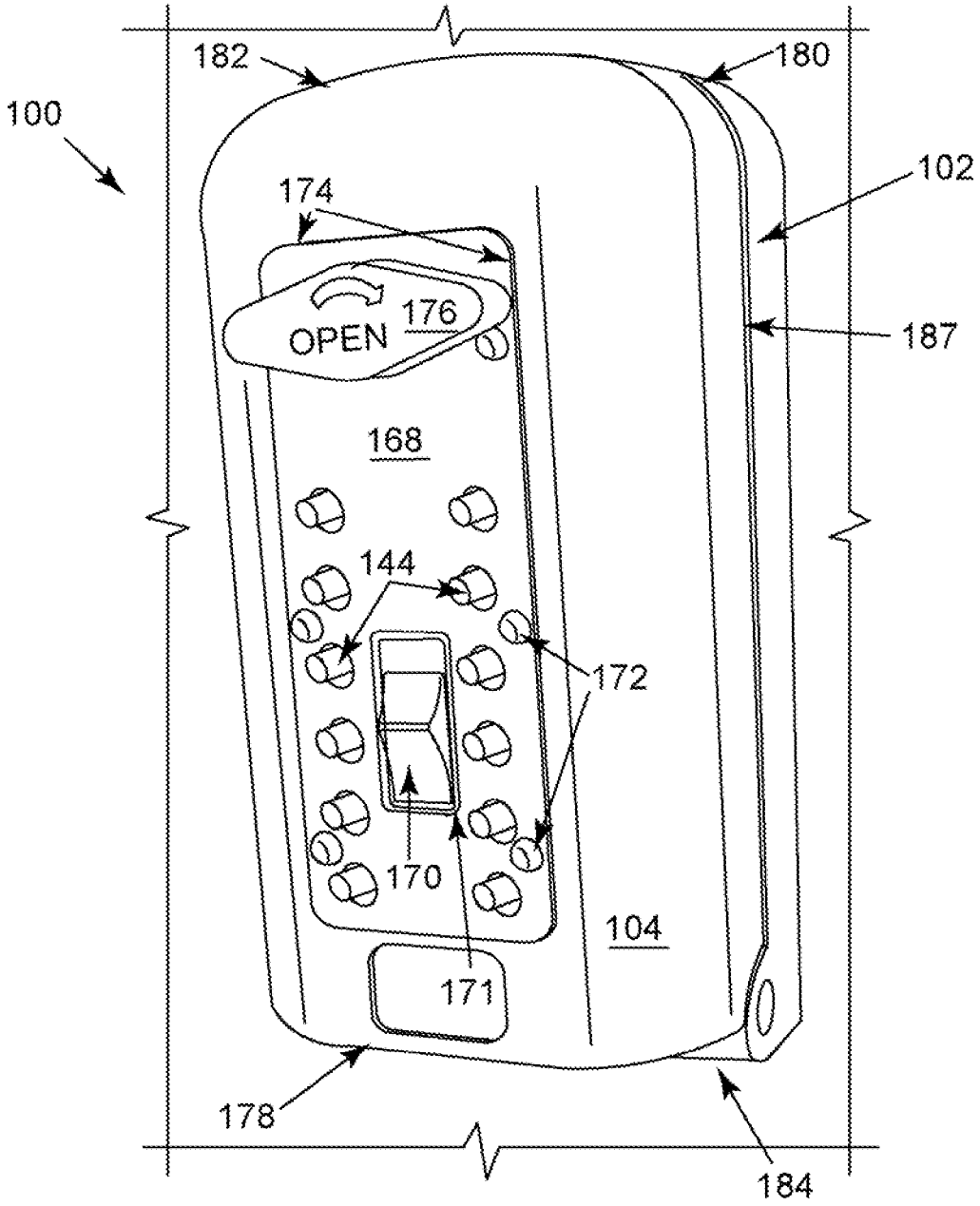
FIG. 6 is a perspective view of the lockable container of FIG. 1 in a closed position.
Figure 7:
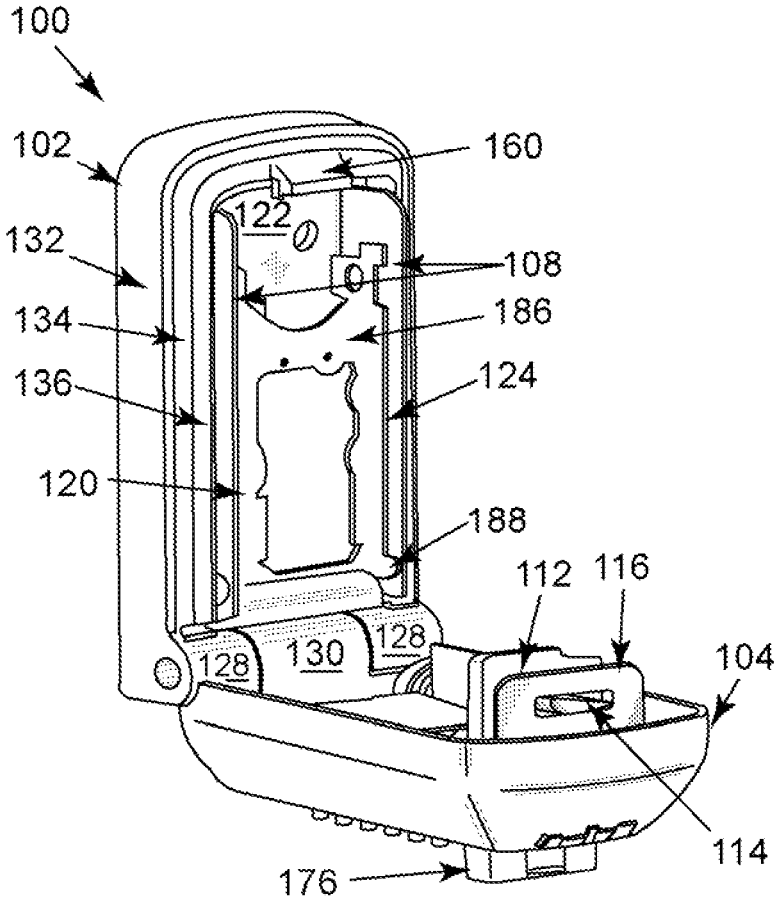
FIG. 7 is a left-side perspective view of the lockable container of FIG. 1 in the open position.

FIG. 1 is a right-side perspective view of an embodiment of a lockable container 100 in an open position. FIGS. 2, 3 and 5 are each a top perspective view of an interior of a second (or front) housing 104 of the lockable container 100. FIG. 4 is a top perspective view of an interior of a first (or back) housing 102 of the lockable container 100. FIG. 6 is a perspective view of the lockable container 100 in a closed position. FIG. 7 is a left-side perspective view of the lockable container 100 in the open position.

Referring to FIGS. 1, 2, 3, 4, 5, 6, and 7, an embodiment of the lockable container 100 has at least one housing 102, 104 comprising a sacrificial material, e.g. a material that breaks away, deforms and/or deflects during physical attempts to pry open or otherwise break into the lockable container 100. In one embodiment, the sacrificial material comprises cast zinc. The at least one housing 102, 104 may comprise a first (back) housing 102, which is configured to be attached to a support surface 146, such as an exterior wall of a building, with one or more permanent or removable first fasteners 118. In one embodiment, the one or more first fasteners 118 are removable threaded hex-bolts, for example of size ¼-20×2½". In another embodiment, the one or more first fasteners 118 are permanent anchors. In either case, the one or more first fasteners 118 are configured to adhere to masonry, concrete, metal, wood, and the like, and pass through openings in both the liner 108 and the second housing 102 before entering the support surface 146. The length, diameter and/or number of the one or more fasteners 118 will vary depending on the type of support surface 146.

The first housing 100 has a first (top) end 180 and a second (bottom) end 184, and a base coupled with a first sidewall 132, which is coupled with a second sidewall 134. The second sidewall 134 is angled relative to the first sidewall 132 and is further coupled with a first interior wall 136, which is inset within a perimeter of the first sidewall 132. A portion of the first interior wall 136 is also angled, but in a direction reversed from an angled portion of a second interior wall 138 of the second housing 104.

Figure 9:
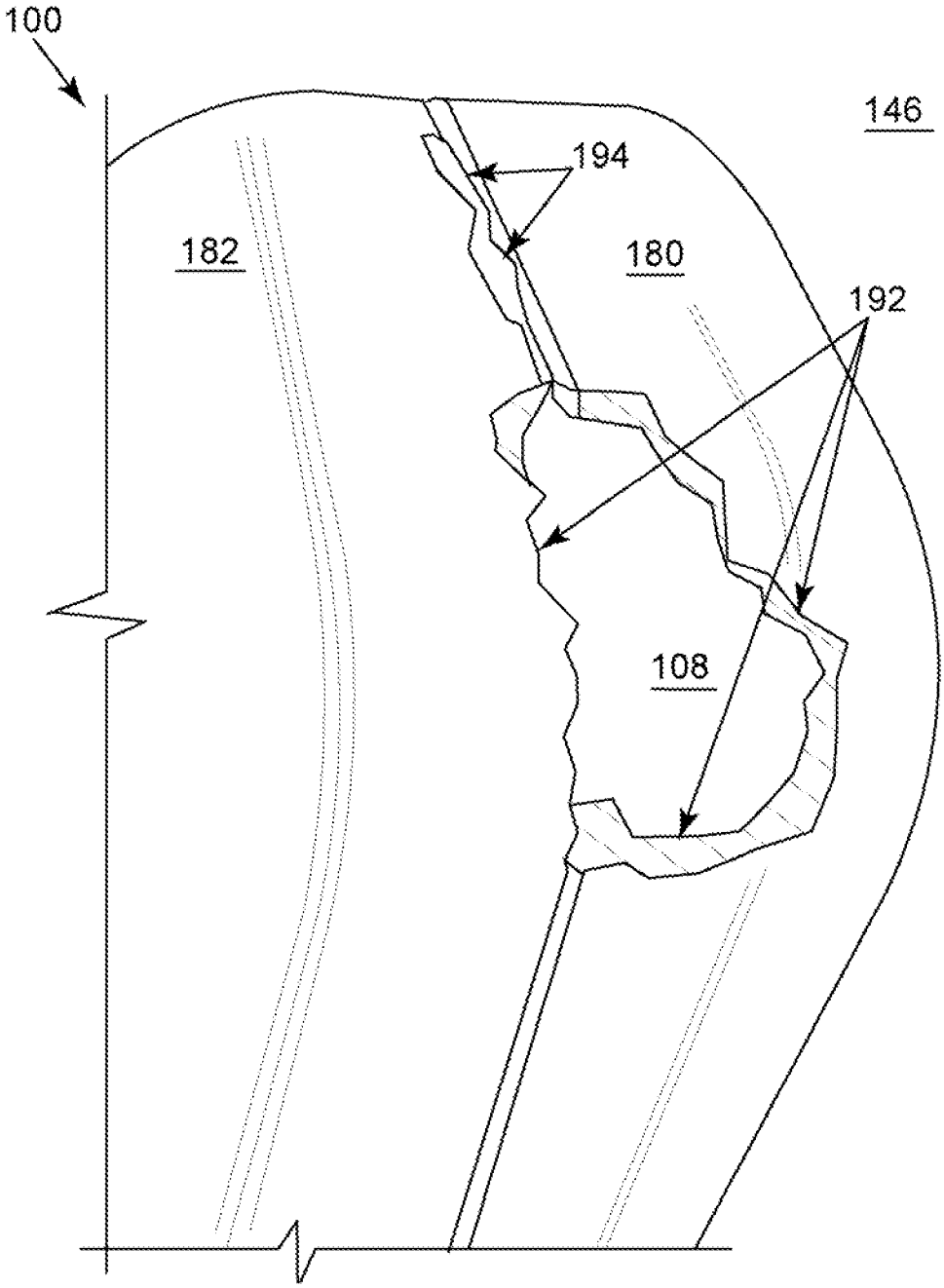
FIG. 9 is a top perspective view of an exterior of an embodiment of the lockable container of FIG. 1 illustrating another failed attempt to break into the lockable container.

The first housing 102 has a cast outer body comprising the sacrificial material and is configured to retain the liner 108, which comprises one of a metal, a metal alloy and/or other type(s) of attack-resistant material(s). As shown in FIG. 9, the cast body may be double-walled. In one embodiment, the liner 108 comprises stainless steel. The liner 108 comprises a base 122 coupled with sidewalls 120, and 124. One function of the liner 108 is to provide a tough material under the heads of the one or more first fasteners 118 to keep them from tearing through the sacrificial housing material during a pry attack carried out against the lockable container 100 while it is coupled with or attached to the support surface 146.

Optionally, the liner 108 may further comprise a first latch sheer plate 154 coupled with the base 122, as shown in FIG. 4. In another embodiment, the first latch sheer plate 154 may be coupled with one or both of the liner sidewalls 120 and 124. The first latch sheer plate 154 comprises a latch opening 156, which is positioned to correspond to a latch recess 158 formed in an interior portion of the first housing's sidewall 132 at the first end 180 of the first housing 102. A portion of the first latch sheer plate 154 may be positioned to engage a reinforcement member 160 formed as part of first housing 102 at the first end 180 thereof. The reinforcement member 160, which may comprise cast zinc, is configured to strengthen and stabilize the first latch sheer plate 154 and/or a second latch sheer plate 116 that is coupled with the second housing 104.

Referring to FIGS. 1 and 4, each of the liner sidewalls 120 and 124 protrudes a predetermined distance 164 above a surface of a first interior wall 136 (FIG. 1) to block a tool inserted between the first housing 102 and the second housing 104 from penetrating into the interior of the lockable container 100 and/or from gaining leverage that could be used to break open the lockable container 100. The portions of the liner sidewalls 120 and 124 that protrude from the first housing 102 are configured to engage the second housing 104 to strengthen the lockable container 100 against pry and hammer attacks. In other words, one or more portions of the liner 108 overlap a gap 187 that forms between the first housing 102 and the second housing 104 when the lockable container 100 is in the closed position.

In one embodiment, one or more first hinge portions 128 are formed at the second (bottom) end 184 of the first housing 102, and one or more second hinge portions 130 are formed at the second (bottom) end 178 of the second housing 104. A cylindrical hinge fastener 138 joins the first hinge portion(s) 128 and the second hinge portion(s) 130. Together, the hinge fastener(s) 138, the first hinge portion(s) 128 and the second hinge portion(s) 130 form a hinge 106. The hinge fastener(s) 138 comprise a metal, such as, but not limited to, stainless steel. In one embodiment, there are two hinge pins 138 that bottom out in holes formed in the second hinge portion 130 of the second housing 104, so the hinge pins cannot be driven out.

A frame 110 having one or more engagement portions 185 is positioned in an interior of and coupled with the second housing 104. As further explained below, the one or more engagement portions 185 are configured to engage one or more tabbed portions 139 of the first anti-tamper plate 148. One or more second fasteners 140 may be used to couple the frame 110 with the second housing 104. As shown in FIGS. 1 and 2, the frame 110 may fit within the perimeter of a second interior wall 141 formed on a mating surface of the second housing 104. As shown in FIG. 2, the second interior wall 141 is angled on the side closest to an exterior of the lockable container 100 to deter and/or defeat pry and/or hammer attacks. More particularly, a portion of the second interior wall 141 is reverse-angled relative to an angled portion of the first interior wall 136 of the first housing 102. When the second housing 104 is in the closed position (as shown in FIG. 6), the second interior wall 141 overlaps the portions of the liner sidewalls 120 and 124 that protrude from the first housing 102. This overlap not only increases the strength of the lockable container 100, but also makes it difficult for a pry tool to slip between the mating surfaces of the first housing 102 and the second housing 104 and gain leverage against either of the liner 108's sidewalls 120, 124. The second interior wall 141 and the first interior wall 136 may each comprise the sacrificial material that comprises the remainder of the second housing 104 and the first housing 102, respectively.

The first end 180 of the first housing 102 comprises a recess 158 configured to receive a latch 114, which protrudes from a latch housing 112 that is positioned within an interior of and coupled with the second housing 104. In one embodiment, as shown in FIG. 3, the latch 114 is multi-sided, having a base 115 coupled with two sidewalls 113. This multi-sided configuration increases the sheer strength of the latch 114. An advantage of the multi-sided latch 114 is that it comprises a thinner and/or lesser expensive piece of material than might normally be required to resist a pry attack, but which is configured as shown and described herein to provide increased bend (e.g., sheer) resistance.

The latch housing 112 and a second latch sheer plate 116, having a latch opening 117 therein, are each positioned within an interior portion and coupled with the second housing 104 and/or with the frame 110 via third fasteners 142. In one embodiment, the second latch sheer plate 116 has first and second members that are substantially orthogonal to each other. The first member of the second sheer plate 116 contains the latch opening 116. The second member of the second sheer plate 116 is positioned beneath the latch housing 112 and may contain one or more openings through which the one or more third fasteners 142 pass to couple the second sheer plate 116 and the latch housing with the frame 110 and/or the second housing 104.

The first latch sheer plate 154 and the second latch sheer plate 116 are configured to overlap when the second housing 104 is in the closed position. When the first latch sheer plate 154 and the second latch sheer plate 116 are overlapped, the latch 114 protrudes through the latch openings 117 and 156 and into the latch recess 158. Use of the first latch sheer plate 154 and the second latch sheer plate 116 adds strength to the lockable container 100 and reduces play and give in the latch 114. Each of the first latch sheer plate 154 and the second latch sheer plate 116 comprises a metal such as, but not limited to, stainless steel.

The latch 114 is coupled with an actuator 176, which may protrude through the body or sidewall of the second housing 140 and/or the first housing 102. The actuator 176 is configured to move the latch 114 from the latch recess 158 and the latch opening 156 after the lock 144 is unlocked. As used herein, the phrase "move the latch" means to release and/or retract the latch.

The lock 144 is coupled with the latch 114 and is configured to retain the latch 114 in a fixed position, protruding through the latch opening 117 formed in the second latch sheer plate 116, through the latch opening 117 formed in the second latch sheer plate 116, through the latch opening 156 formed in the first latch sheer plate 154 and into the latch recess 1458 when the second housing 104 is in the closed position (shown in FIG. 6), until an authorized key and/or access code is provided to unlock the lock 144. In the exemplary embodiment shown in the figures, the lock 144 is a pushbutton lock. However, lock 144 is not limited to pushbutton locks, and may be any type of mechanical, electrical, or electro-mechanical locking apparatus.

Referring to FIGS. 2 and 5, a first anti-tamper plate 148 is positioned within an interior portion of and coupled with the second housing 104 and/or the frame 110. For example, in one embodiment, a fourth fastener 150 protrudes through an opening in the first anti-tamper plate 148 and into an opening 166 in the frame 110. As shown in FIG. 2, one or more tabbed portions 139 of the first anti-tamper plate 148 are overlapped and secured by corresponding one or more portions of the latch housing 112. Additionally, or alternatively, the one or more tabbed portions 139 of the first anti-tamper plate 148 may contain openings through which the second fasteners 140 pass. In one embodiment, the first anti-tamper plate 148 is configured to prevent elements of the lock 144 from being punched inward and broken.

Referring to FIG. 6, a second anti-tamper plate 168 is positioned on an exterior portion of and coupled with the second housing 104. The second anti-tamper plate 168 may be positioned within a recess 174 formed in the exterior body of the second housing 104. One or more fifth fasteners 172 may pass through one or more corresponding openings in the second anti-tamper plate 172 and into the body of the second housing 104. In one embodiment, the one or more fifth fasteners 172 are rivets. The second anti-tamper plate 168 may have an opening 171 formed therein to allow a button 170 to protrude therethrough. In one embodiment, the button 170 is movable between a first position that does not clear any code entered on lock 144 and a second position that clears any code entered on lock 144.

Turning now to FIG. 7, a storage tray 186, configured to store an object, may be coupled with the liner 108. The object stored by the tray 186 may be a key, a card key, a smart card, or any other type of useful object. The storage tray 186 is configured to move between a first closed position (shown in FIG. 6), in which it is within an interior of the liner 108, and second open position (not shown), in which it parallels the second housing 104 and protrudes from the liner 108. The storage tray 186 may be coupled with the liner 108 by a hinge or fastener 188. In FIG. 7, this hinge or fastener 188 is located at an end of the storage tray 186.

Referring back briefly to FIG. 3, an embodiment of the lockable container 100 may comprise an alarm sensor 152 configured to output a signal when an unauthorized attempt is made (i) to open the lockable container 100 and/or (ii) to remove the lockable container 100 from the support surface 146. The alarm sensor 152 may also be configured to output a signal when the lockable container 100 is actually opened and/or when the lockable container 100 is actually removed from the support surface 146. In one embodiment, the alarm sensor 152 comprises a donut-shaped magnet positioned in a recess formed in the latch housing 112. In one embodiment, the alarm sensor 152 may be a magnetic sensor such as sensor model R1075 manufactured by the General Electric Company. An active part of the alarm sensor 152 is located in, on, or behind the support surface 146, in an area thereof proximate the first housing 102 that is within activation range of the magnet and/or the magnet's magnetic field only when the second housing 104 is closed and the first housing 102 is properly positioned on, and/or coupled with or attached to, the support surface 146. In one embodiment, a single alarm sensor is used to detect both an opening of the lockable container 100 and removal of the lockable container 100 from the support surface 146.

Prototypes and Test Results

Figure 8:
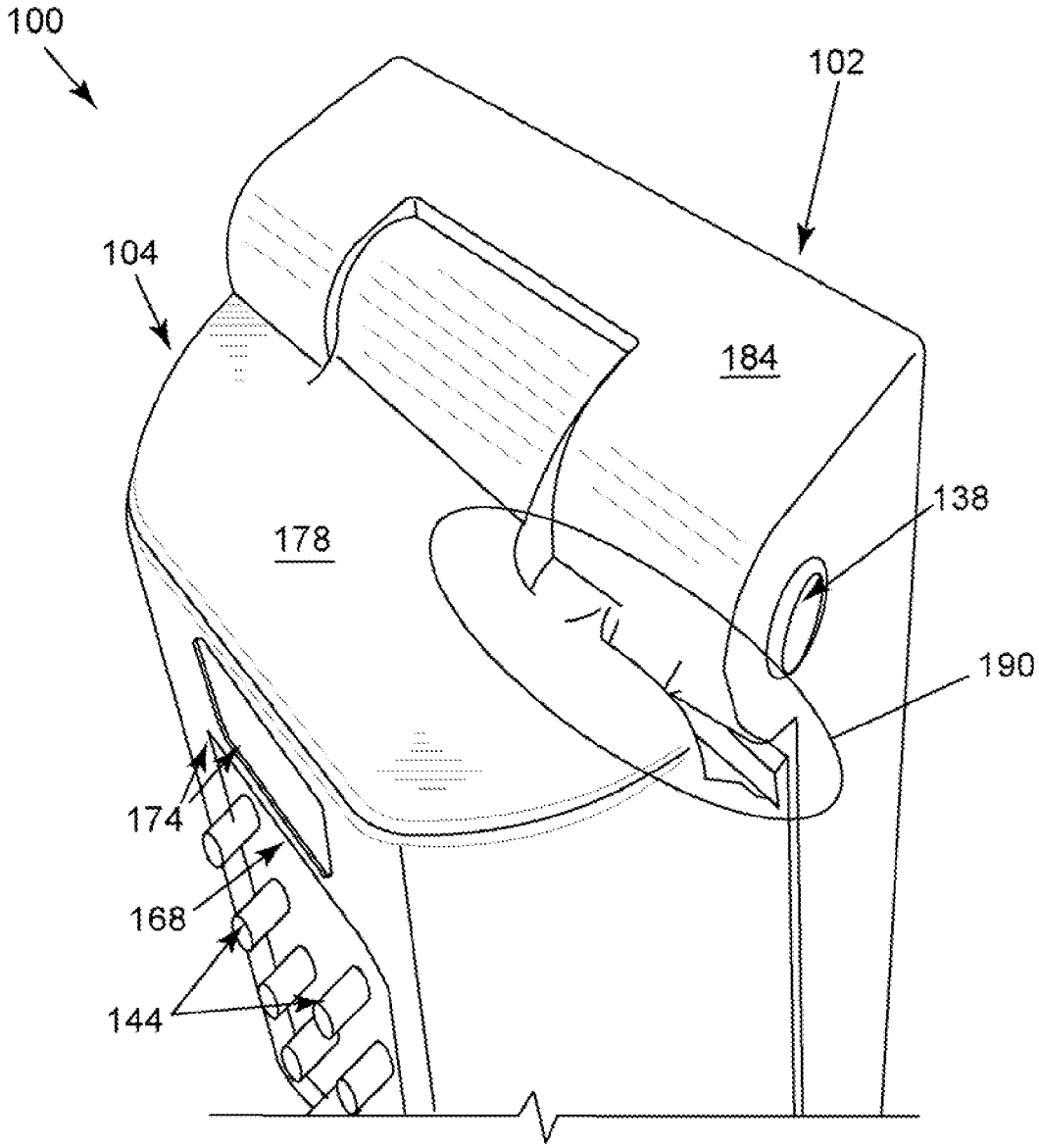
FIG. 8 is a bottom perspective view of an exterior of an embodiment of the lockable container of FIG. 1 illustrating a failed attempt to break into the lockable container.

FIG. 8 is a bottom perspective view of an exterior of an embodiment of the lockable container 100 illustrating a failed attempt to break into the lockable container. FIG. 9 is a top perspective view of an exterior of an embodiment of the lockable container 100 illustrating another failed attempt to break into the lockable container.

A prototype of the lockable container 100 described herein was built and tested for attack resistance against tools ranging from a small screwdriver to a sledgehammer and to a crowbar approximately 0.77 m long. Results are shown in FIGS. 8 and 9, and it is believed that the prototype passed at least Loss Prevention Certification Board's (LPCB's) Loss Prevention Standard (LPS) 1175 Level 1, promulgated and maintained by BRE Global Limited of Watford, United Kingdom.

As shown in FIG. 8, the attacked area 190, at the junction of the second (bottom) end 178 of the second housing 104 and the second (bottom) end 184 of the first housing 102, reveals that the cast sacrificial material merely deformed and/or chipped away, thus preventing the lockable container 100 from being pried open.

As shown in FIG. 9, the attacked areas 192 and 194, at the junction of the first (top) end 182 of the second housing 104 and the first (top) end 180 of the first housing 102, reveals that the cast sacrificial material again merely deformed in attack area 194 and chipped away in attack area 192, thus preventing the lockable container 100 from being pried open. In this figure, an inner wall of the first housing 102, not the liner 108, can be seen through the attack area 192.

The physical properties of the cast sacrificial material and the configuration of the various elements of the lockable container 100 are such that it is very difficult to gain leverage when attempts are made to pry the lockable container 100 open. In fact, use of the 0.77 m crowbar only resulted in pulling the first fasteners 118 out of the support surface 146. All attempts to breach the liner 108 with various screwdrivers, hammers and other pry tools were unsuccessful.

Exemplary Operation

Referring again to FIGS. 1, 2, 3, 4, 5, 6 and 7, in use, a predetermined access code is provided to the lock 144 while the lockable container 100 is in the closed position shown in FIG. 6. The actuator 176 protruding from an exterior of the second housing 104 is then turned. If the access code is valid and was entered correctly, turning the actuator 176 causes the latch 114 to move to an unlocked position, allowing the second housing 104 to hinge open, as shown in FIGS. 1 and 7. If the access code was invalid or entered incorrectly, the actuator 176 will not turn or will turn without allowing the second housing 104 to hinge open. A tray 186, coupled within an interior of the metal liner 108 is configured to store one or more types of predetermined objects, just as keys, card keys, smartcards, etc. In one embodiment, the tray 186 is configured to hinge open as the second housing 104 hinges open and to hinge shut as the second housing 104 hinges shut. Alternatively, the tray 186 is configured to be hinged open and/or closed by hand, independent of the opening or closing of the second housing 104.

Under pry attack the cast outer wall of either the second housing 104 or the first housing 102 gives way before enough leverage can cause the locking mechanism to fail. The inner liner 108 provides a last line of defense against physical attack. The cast housing delays the access to the inner liner 108. Additionally, the reverse angled adjoining (e.g. mating) surfaces of the first interior wall 136 of the first housing 102 and of the second interior wall 141 of the second housing 104 make it difficult to insert a tool such as a screwdriver into the gap 187 because the tool handle hits the support surface 146 first before the longitudinal axis of the tool becomes parallel with the mating surfaces of the first housing 102 and the second housing 104. In other words, the first housing 102 comprises an angled interior wall 136 and the second housing 104 comprises a reverse-angled interior wall 141, which are configured to cause an longitudinal axis of an attack tool to intersect a support surface 146 when the first housing 102 and the second housing are in a closed position 104, shown in FIG. 6. Even though second housing 104 is made of a sacrificial material, its thick walls make it resistant to penetration attack, while the thin leading edge of the first housing 104's first interior wall 136 make it difficult to pry.

Methods

Figure 10A:
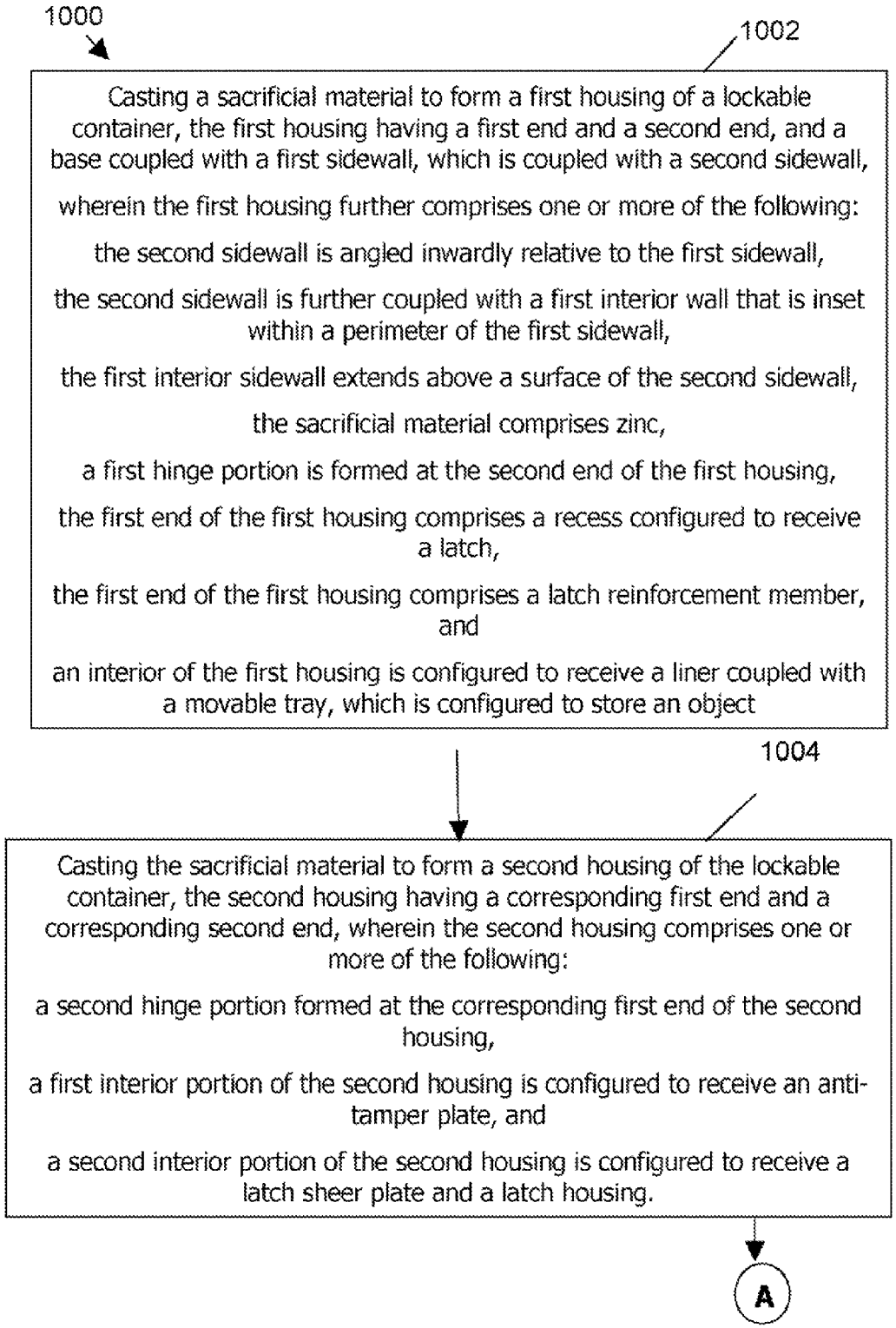
FIGS. 10A and 10B are a flowchart illustrating an embodiment of a method of manufacturing an embodiment of the lockable container of FIG. 1.
Figure 10B:
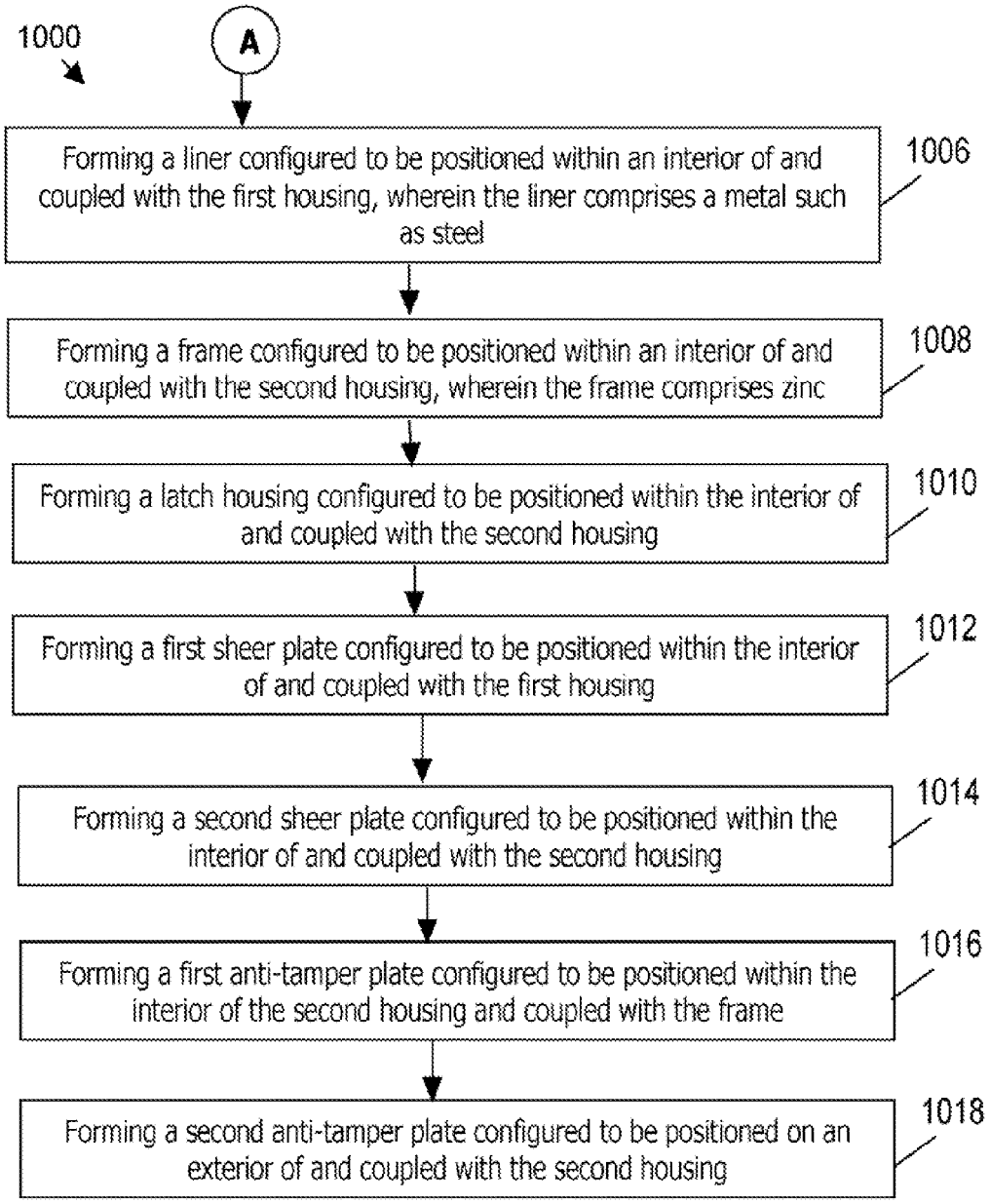

FIGS. 10A and 10B are a flowchart illustrating an embodiment of a method 1000 of manufacturing an embodiment of the lockable container 100 of FIG. 1. Unless otherwise noted, the elements 1002, 1004, 1006, 1008, 1010, 1012, 1014, 1016 and 1018 can be performed concurrently and/or in any suitable order. It is contemplated that a machine, such as a robot, can be configured to perform one or more of these elements.

Referring to FIGS. 1, 2, 3, 4, 5, 6, 7, 10A and 10B, the method 1000 comprises casting 1002 a sacrificial material to form a first housing 102 of a lockable container 100. Components of the first housing 102 were described above. The method 1000 further comprises casting 1004 the sacrificial material to form a second housing 104 of the lockable container 100. The second housing 104 and components thereof were described above. The method 1000 further comprises forming 1006 a liner 108 configured to be positioned within an interior of and coupled with the first housing 102. The method 1000 further comprises forming 1008 a frame 110 configured to be positioned within an interior of and coupled with the second housing 104. The method 1000 further comprises forming 1010 a latch housing 112 configured to be positioned within the interior of and coupled with the second housing 104. The method 1000 further comprises forming 1012 a first sheer plate 154 configured to be positioned within the interior of and coupled with the first housing 102. The method 1000 further comprises forming 1014 a second sheer plate 116 configured to be positioned within the interior of and coupled with the second housing 104. The method 1000 further comprises forming 1016 a first anti-tamper plate 148 configured to be positioned within the interior of the second housing 104 and coupled with the frame 110. The method 1000 optionally further comprises forming 1018 a second anti-tamper plate 168 configured to be positioned on an exterior of and coupled with the second housing 104.

Figure 11:
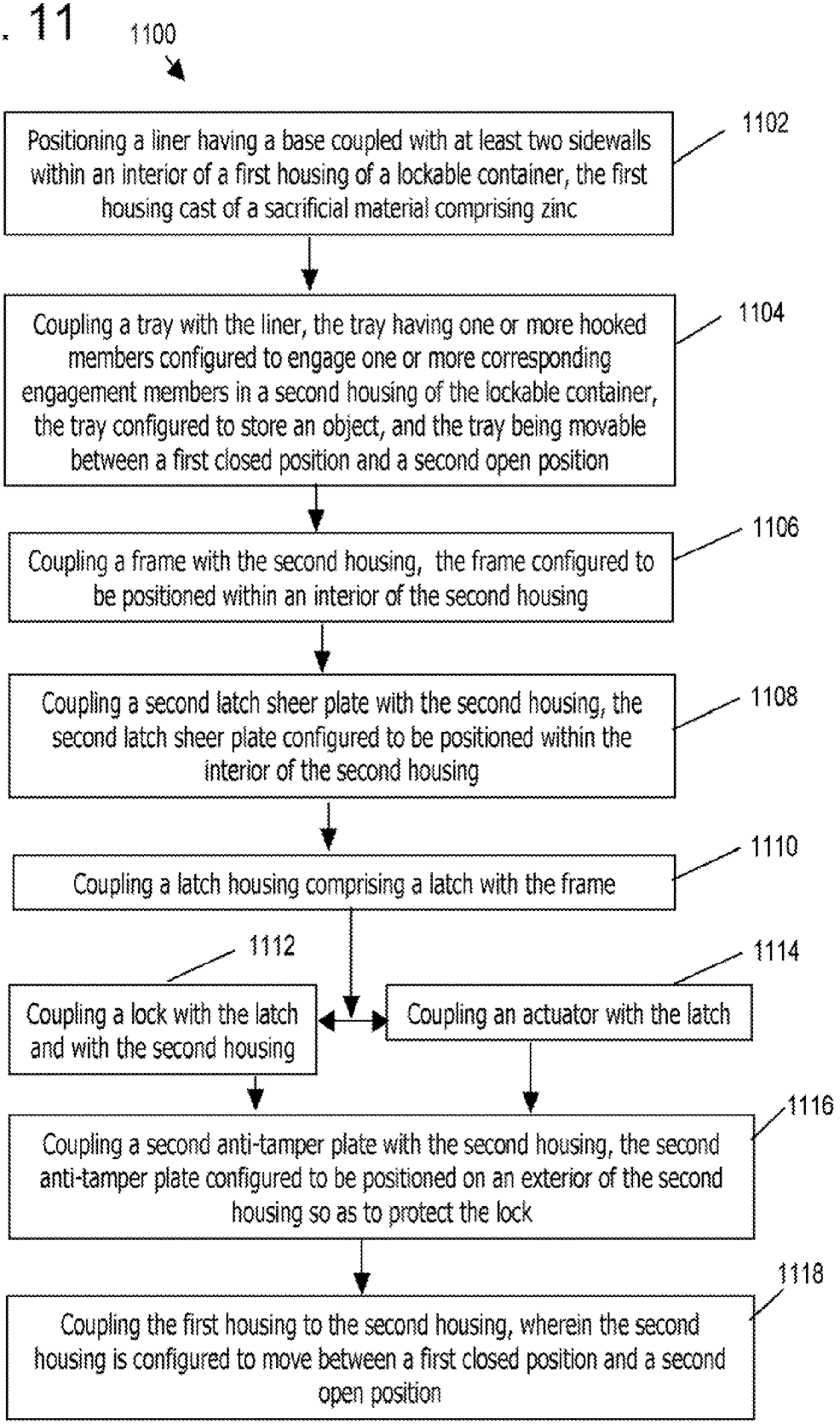
FIG. 11 is another flowchart illustrating an embodiment of a method of assembling an embodiment of the lockable container of FIG. 1.

FIG. 11 is another flowchart illustrating an embodiment of a method 1100 of assembling an embodiment of the lockable container 100 of FIG. 1. Unless otherwise noted, the elements 1102, 1104, 1106, 1108, 1110, 1112, 1114, 1116 and 1118 can be performed concurrently and/or in any suitable order. It is contemplated that a machine, such as a robot, can be configured to perform one or more of these elements.

Referring to FIGS. 1, 2, 3, 4, 5, 5, 7 and 11, an embodiment of the method 1100 comprises positioning 1102 a liner 108 having a base 122 coupled with at least two sidewalls 120, 124 within an interior of a first housing 102 of a lockable container 100, the first housing 102 cast of a sacrificial material comprising zinc. The method 1100 further comprises coupling 1104 a tray 186 with the liner 108, the tray 186 configured to store an object, and the tray 186 being movable between a first closed position and a second open position. A fastener 188 may couple the tray 186 with the liner 108. The method 1100 further comprises coupling 1106 a frame 110 with the second housing 104, the frame 110 configured to be positioned within an interior of the second housing 104. The method 1100 further comprises coupling 1108 a second latch sheer plate 116 with the second housing 104, the second latch sheer plate 116 configured to be positioned within the interior of the second housing 104. The method 1100 further comprises coupling 1110 a latch housing 112 comprising a latch 114 with the frame 110. The method 1100 further comprises coupling 1112 a lock 144 with the latch 114 and with the second housing 104. The method 1100 further comprises coupling 1114 an actuator 176 with the latch 114 so that movement of the actuator 176 causes the latch 114 to engage or disengage at least one of a recess 158 formed in a first end 180 of the first housing and a first latch sheer plate 154. The method 1100 further comprises coupling 1116 a second anti-tamper plate 168 with the second housing 104, the second anti-tamper plate 168 configured to be positioned on an exterior of the second housing 104 so as to protect the lock 144. The method 1100 further comprises coupling 1118 the first housing 102 to the second housing 104, wherein the second housing 104 is configured to move between a first closed position and a second open position.

Areas of Application

Embodiments of the lockable container 100 described herein have application in various fields, particularly the home-health care market. Other fields include, but are not limited to: real-estate, homeowner use, property management, vacation rentals, lockable containers such as tool boxes, and the like.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the scope of the following claims.

What is claimed is:

1. A lockable container, comprising:

a first housing having one or more first hinge portions; a second housing coupled with the first housing and having one or more second hinge portions configured to mate with the one or more first hinge portions so as to form a hinge, the first housing, the second housing, or both comprising a sacrificial material that breaks away, deflects and/or deforms under physical attack, the first and second housings being pivotally coupled and relatively moveable between an open position and a closed position, wherein the first and second housings mate together in the closed position;

a latch;

a lock coupled with the latch, wherein the lock is secured to one of the first housing and the second housing;

an actuator coupled with the latch and configured to move the latch when the lock is unlocked;

a liner positioned within an interior of and coupled with the first housing, the second housing, or both, and positioned between the first and second housings when the first and second housings are in the closed position, the liner configured to store an object, and comprising an attack-resistant material that resists physical attack, the liner comprising a base and a first latch sheer plate coupled with the base and containing a latch opening; and a second latch sheer plate positioned within the interior of and secured to the second housing to move with the second housing, the second latch sheer plate having another latch opening therein and being configured to overlap the latch opening of the first latch sheer plate when the second housing is in a closed position;

the latch passing through both the first latch sheer plate and the second latch sheer plate upon locking of the lock to secure the first housing to the second housing;

wherein at least a portion of the first housing, at least a portion of the second housing, or both are configured to break away, deflect, and/or deform under a physical attack prior to the lock, or latch, or both failing under the physical attack.

2. The lockable container of claim 1, wherein the sacrificial material comprises cast zinc.

3. The lockable container of claim 1, wherein:

the liner is positioned within the first housing, and the latch, actuator and lock are positioned in the second housing.

4. The lockable container of claim 3, further comprising:

a tray movably coupled with the liner and configured to store an object.

5. The lockable container of claim 4, wherein the liner is configured to overlap a gap between the first housing and the second housing.

6. The lockable container of claim 1, wherein the latch comprises:

a base; and two sidewalls coupled with the base.

7. The lockable container of claim 1, wherein:

the first housing comprises a base and a first interior wall extending from the base, the first interior wall comprising an angled portion that is disposed at an acute angle with respect to the base; and the second housing further comprises a base and a second interior wall having a reverse-angled portion disposed at an acute angle relative to the base of the second housing, wherein the angled portion of the first interior wall is configured to mate with the reverse-angled portion of the second interior wall when the first housing and the second housing are in the closed position.

8. The lockable container of claim 7, wherein the first and second interior walls are at least partially constructed of the sacrificial material.

9. The lockable container of claim 1, wherein the attack-resistant material comprises a metal, a metal alloy, or a combination thereof.

10. The lockable container of claim 1, wherein the first and second housings are pivotally coupled together.

11. The lockable container of claim 7, wherein the second interior wall extends from the base of the second housing.

12. The lockable container of claim 7, wherein an interface between the reverse-angled portion of the second interior wall and the angled portion of the first interior wall, when the first and second housings are in the closed position, is configured to cause a longitudinal axis of an attack tool to intersect a support surface to which the first housing is coupled.

13. The lockable container of claim 1, wherein the acute angle of the reverse-angled portion of the second interior wall is substantially complementary to the acute angle of the angled portion of the first interior wall.

14. The lockable container of claim 1, wherein the sacrificial material has a first toughness and the attack-resistant material has a second toughness, the first toughness being lower than the second toughness.

15. The lockable container of claim 1, wherein the liner is substantially in tact after the at least a portion of the first housing, the at least a portion of the second housing, or both break away, deflect, and/or deform under the physical attack.

16. A lockable container, comprising:

a first housing having one or more first hinge portions; a second housing coupled with the first housing and having one or more second hinge portions configured to mate with the one or more first hinge portions so as to form a hinge, the first and second housings being pivotally coupled and relatively moveable between an open position and a closed position, wherein the first and second housings mate together in the closed position;

a latch;

a lock coupled with the latch, wherein the lock is secured to one of the first housing and the second housing;

an actuator coupled with the latch and configured to move the latch when the lock is unlocked;

a liner positioned within an interior of and coupled with the first housing, the second housing, or both, and positioned between the first and second housings when the first and second housings are in the closed position, the liner configured to store an object, and comprising an attack-resistant material that resists physical attack, the liner comprising a base and a first latch sheer plate coupled with the base and containing a latch opening; and a second latch sheer plate positioned within the interior of and secured to the second housing to move with the second housing, the second latch sheer plate having another latch opening therein and being configured to overlap the latch opening of the first latch sheer plate when the second housing is in a closed position;

the latch passing through both the first latch sheer plate and the second latch sheer plate upon locking of the lock to secure the first housing to the second housing.

17. The lockable container of claim 16, wherein:

the first housing has a first leading edge;

the second housing has a second leading edge;

the first leading edge and the second leading edge being juxtaposed upon locking of the lock;

at least one of the first leading edge and second leading edge being of reduced thickness relative to portions of the first housing or second housing to promote break away of the at least one of the first leading edge and second leading edge upon a pry attack.

* * * * *